US009272764B2

(12) United States Patent
Bamba

(10) Patent No.: US 9,272,764 B2
(45) Date of Patent: Mar. 1, 2016

(54) REMOTE CONTROL DEVICE FOR VESSEL AND REMOTE CONTROL METHOD FOR VESSEL PROPULSION DEVICE

(71) Applicant: YAMAHA HATSUDOKI KABUSHIKI KAISHA, Iwata-shi, Shizuoka (JP)

(72) Inventor: Takaaki Bamba, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 116 days.

(21) Appl. No.: 14/230,117

(22) Filed: Mar. 31, 2014

(65) Prior Publication Data

US 2014/0303809 A1 Oct. 9, 2014

(30) Foreign Application Priority Data

Apr. 8, 2013 (JP) ..... 2013-080352

(51) Int. Cl.

| | |
|---|---|
| ***B63H 21/21*** | (2006.01) |
| ***F02D 11/02*** | (2006.01) |
| ***F02D 11/10*** | (2006.01) |
| ***B63H 20/00*** | (2006.01) |
| *F02B 61/04* | (2006.01) |

(52) U.S. Cl.

CPC ..... *B63H 21/213* (2013.01); *B63H 20/00* (2013.01); *F02D 11/02* (2013.01); *F02D 11/10* (2013.01); *B63H 2021/216* (2013.01); *F02B 61/045* (2013.01); *F02D 2011/101* (2013.01); *Y10T 74/20232* (2015.01); *Y10T 477/60* (2015.01)

(58) Field of Classification Search

CPC ..... B63H 21/213; B63H 20/00; B63H 2021/216; F02D 11/02; F02D 11/10; F02D 2011/101; F02B 61/045; Y10T 74/20232; Y10T 477/60

USPC ..... 701/2, 62; 123/400; 74/480 B; 477/34

See application file for complete search history.

(56) References Cited

U.S. PATENT DOCUMENTS

| | | | | |
|---|---|---|---|---|
| 4,253,349 | A * | 3/1981 | Floeter | B63H 21/213 477/113 |
| 4,794,820 | A * | 1/1989 | Floeter | B63H 21/213 477/34 |
| 6,047,609 | A * | 4/2000 | Brower | B63H 21/213 440/86 |
| 6,273,771 | B1 * | 8/2001 | Buckley | B63H 21/213 114/144 RE |
| 6,866,022 | B1 * | 3/2005 | Phillips | B63H 21/213 123/400 |
| 7,530,865 | B2 * | 5/2009 | Kado | B63H 21/213 440/1 |
| 7,836,787 | B2 * | 11/2010 | Oguma | B63H 21/213 440/1 |
| 7,972,243 | B2 * | 7/2011 | Kado | B63H 21/213 440/1 |
| 2010/0185342 | A1 * | 7/2010 | Wubker, Jr. | G05D 1/0206 701/2 |
| 2012/0197467 | A1 * | 8/2012 | Morvillo | B63H 11/107 701/21 |

* cited by examiner

FOREIGN PATENT DOCUMENTS

JP 2006-62481 A 3/2006

*Primary Examiner* — Russell Frejd

(74) *Attorney, Agent, or Firm* — Keating and Bennett, LLP

(57) ABSTRACT

A remote control device for a vessel is installed in a vessel and remotely controls a vessel propulsion device of the vessel. The remote control device includes an operation member, an operation load applying mechanism, a control section, and an actuator. The operation member is supported rotatably around a rotation axis, and is operated by an operator to switch the shift position of a forward-reverse switching mechanism in the vessel propulsion device according to the operation angle of the operation member. The operation load applying mechanism applies an operation load to the operation member. The control section controls the operation load. The operation load applying mechanism includes an actuator that adjusts the operation load. The control section is arranged to control the actuator based on a vessel speed of the vessel.

19 Claims, 11 Drawing Sheets

REMOTE CONTROL DEVICE FOR VESSEL AND REMOTE CONTROL METHOD FOR VESSEL PROPULSION DEVICE

BACKGROUND OF THE INVENTION

1. Field of the Invention

The present invention relates to a remote control device for a vessel that is installed in a vessel and remotely controls a vessel propulsion device, and a remote control method for a vessel propulsion device.

2. Description of the Related Art

A vessel propulsion device such as an outboard motor is attached to a hull of a vessel so as to apply thrust to the hull. For example, an outboard motor includes an engine and propeller blades. The outboard motor rotates the propeller blades in response to a torque from the engine to generate thrust. The outboard motor further includes a forward-reverse switching mechanism that changes the rotating direction of the propeller blades. By switching the shift position in the forward-reverse switching mechanism between a forward shift position and a reverse shift position, the rotating direction of the propeller blades is switched.

An electronic control type remote control device that remotely controls such a vessel propulsion device is known. In this electronic control type remote control device, an operation angle of an operation lever is detected, and according to the detected operation angle, the vessel propulsion device is controlled. Therefore, the operation lever itself is operable with a small operation load.

However, for example, in a case where a hull rocks during high-speed traveling, etc., there is a need to hold the position of the operation lever. Therefore, for example, in Japanese Unexamined Patent Application Publication No. 2006-62481, a device arranged to increase a frictional force to be applied to the support shaft of the operation lever as the operation angle of the operation lever increases is disclosed. In detail, in this device, the support shaft of the operation lever has an oval shape (cam shape) in section, and the device is arranged to apply a frictional force to the support shaft by a pressing mechanism.

SUMMARY OF THE INVENTION

The inventor of preferred embodiments of the present invention described and claimed in the present application conducted an extensive study and research regarding remote control for a vessel propulsion device, such as the one described above, and in doing so, discovered and first recognized new unique challenges and previously unrecognized possibilities for improvements as described in greater detail below.

In a high-speed traveling state where a vessel travels at a high speed, from the point of view of protection of the engine of the outboard motor, the shift position of the forward-reverse switching mechanism should not be switched, for example, from the forward shift position to the reverse shift position.

However, in the remote control device relating to the above-described conventional technology, the shift switching operation during high-speed traveling cannot be prevented as described in more detail below.

In the above-described device, an operator operates a single operation lever to perform an engine output adjusting operation and a shift switching operation, and the operation load increases as the operation angle of the operation lever increases. The region in which the operation angle of the operation lever is large is an operation region for adjusting the engine output. On the other hand, an operation region for shift switching is a region in which the operation angle of the operation lever is small. In this shift switching operation region, the operation load of the operation lever is small. Therefore, in this device, a shift switching operation is easily performed even during high-speed traveling.

In particular, in an outboard motor using a dog clutch, a shift switching operation during high-speed traveling should be avoided. This is because a great impact may be generated in the forward-reverse switching mechanism at the time of a shift switching operation. Especially, when a shift switching operation to switch from forward to reverse is performed during high-speed traveling, a great impact is generated at the time of shift switching in the forward-reverse switching mechanism, and this great impact is transmitted to a power transmission system and the engine.

For protecting the engine even when an operator performs a shift switching operation during high-speed traveling, it may be considered that the forward-reverse switching mechanism is controlled so that an actual shift switching operation in the forward-reverse switching mechanism occurs after the engine rotation speed has reduced to be lower than a predetermined value. With this control, an engine trouble to be caused by a shift switching operation during high-speed traveling can be prevented from occurring.

However, the shift switching operation of the forward-reverse switching mechanism falls behind the shift switching operation performed with the operation lever, so that the operation feeling is not always good.

Therefore, a preferred embodiment of the present invention provides a remote control device for a vessel and a remote control method that prevents a shift switching operation during high-speed traveling and provides a good operation feeling.

A preferred embodiment of the present invention provides a remote control device for a vessel that is installed in a vessel and remotely controls a vessel propulsion device of the vessel. This remote control device for a vessel includes an operation member, an operation load applying mechanism, a control section, and an actuator. The operation member is supported rotatably around a rotation axis, and is operated by an operator to switch the shift position of the forward-reverse switching mechanism in the vessel propulsion device according to an operation angle of the operation member. The operation load applying mechanism applies an operation load to the operation member. The control section controls the operation load. The operation load applying mechanism includes an actuator that adjusts the operation load. The control section is programmed to control the actuator based on a vessel speed of the vessel.

In this remote control device for a vessel, the control section controls the actuator to adjust the operation load of the operation member based on the vessel speed of the vessel. For example, the control section may control the actuator so that the operation load of the operation member becomes large in a predetermined shift switching operation range during high-speed traveling at a traveling speed of the vessel equal to or higher than a predetermined value. Accordingly, a shift switching operation during high-speed traveling is prevented. The control section may be configured and programmed to control the actuator so that the operation load of the operation member becomes smaller than the above-described operation load for high-speed traveling in a predetermined shift switching operation range during low-speed traveling at a traveling speed of the vessel lower than a predetermined value. Accordingly, the operation load for shift switching is small, so that the operability of the shift switching operation is improved. In addition, the shift switching operation can be performed with a small operating force only during low-speed traveling, so that the response delay until the actual shift switching from the shift switching operation with the operation member is reduced. Accordingly, the operation feeling is improved.

Thus, a shift switching operation during high-speed traveling is prevented, and the operation feeling is further improved.

The remote control device for a vessel is preferably arranged as follows. The operation member may include an operation lever and a rotating member that rotates according to an operation of the operation lever. The operation lever may be supported rotatably around a rotation axis in a predetermined angle range. The operation load applying mechanism may further include a contact member that comes into contact with the rotating member. The actuator may change a pressing load to be applied to the rotating member. By this control of the actuator, the operation load of the operation lever is changed.

The operation load applying mechanism is preferably arranged as follows. The operation load applying mechanism may further include an elastic member that presses the contact member against the rotating member. The actuator may change the pressing load to be applied to the contact member by the elastic member. With this arrangement, the contact member is pressed against the rotating member by the elastic member. When the actuator is controlled, the pressing load to be applied to the contact member is changed, and accordingly, the pressing load to be applied to the rotating member by the contact member is changed. Therefore, by controlling the actuator, the magnitude of the operation load of the operation lever and the timing to change the operation load is controlled.

The rotating member is preferably arranged as follows. The rotating member may include a plurality of recesses (hereinafter, also referred to as "notches") arranged so that the contact member fits therein to enable the contact member to come out therefrom at positions different in the rotating direction around the rotation axis. By selectively fitting the contact member in these recesses, the operation lever is positioned. In this positioning state, a large operation load is necessary to cause the contact member to come out from the recess. By changing the pressing load to be applied to the rotating member by the contact member, the operation load of the operation member at a position corresponding to the recess is changed.

The contact member preferably includes a rolling member arranged so as to move while rolling on the surface of the rotating member with respect to the rotating member according to rotation of the rotating member around the rotation axis. The rolling member may be a columnar member, a cylindrical member, or a spherical member. The elastic member preferably includes a spring.

The vessel propulsion device may include an engine. In this case, the vessel speed may be determined based on the rotation speed of the engine. Alternatively, the vessel speed may be determined by a vessel speed detection device. The vessel speed detection device may include, for example, a pitot tube, a GPS (global positioning system), or a paddle wheel equipped on the vessel.

The vessel propulsion device and the remote control device may be connected to each other with a wire or wirelessly, and the vessel speed may be detected in the vessel propulsion device. In this case, a detection signal from the vessel propulsion device is transmitted to the remote control device with a wire or wirelessly. A control signal from the remote control device may also be transmitted to the vessel propulsion device with a wire or wirelessly.

When the vessel propulsion device includes an engine, the operation member may be arranged to be operated by an operator to switch the shift position and to change the throttle opening degree of the engine according to the operation angle of the operation member.

The forward-reverse switching mechanism may include a drive gear, a forward gear, a reverse gear, and a dog clutch. The drive gear is driven by a drive source (for example, engine) of the vessel propulsion device. The forward gear and the reverse gear engage with the drive gear and are driven by the drive gear. The dog clutch selectively engages with the forward gear or the reverse gear. The forward-reverse switching mechanism switches the drive force transmitting state by switching engagement of the dog clutch between engagement with the forward gear and engagement with the reverse gear. Specifically, the shift position is the position of the dog clutch. The shift position includes a forward shift position, a reverse shift position, and a neutral shift position. The forward shift position is a position at which the dog clutch engages with the forward gear. The reverse shift position is a position at which the dog clutch engages with the reverse gear. The neutral shift position is a position at which the dog clutch engages with neither of the forward gear nor the reverse gear.

The control section may control the actuator as follows when performing a shift switching operation to switch the shift position from the forward (or reverse) shift position to the reverse (or forward) shift position in a case where the vessel speed is equal to or higher than a predetermined value. Specifically, the control section may control the actuator so that the operation load of the operation member necessary for the shift switching operation becomes larger than the operation load of the operation member necessary for an operation other than the shift switching operation.

The control section may control the actuator when performing the above-described shift switching operation in a case where the vessel speed is equal to or higher than the predetermined value. Specifically, the control section controls the actuator so that the operation load to be applied to the operation member becomes larger, over a predetermined shift switching operation range of the operation member, than an operation load to be applied to the operation member for an operation other than the shift switching operation.

The control section may control the actuator as follows when performing the above-described shift switching operation in a case where the vessel speed is equal to or higher than the predetermined value. Specifically, the control section may control the actuator so that the operation load of the operation member increases at a timing at which the shift position in the forward-reverse switching mechanism has been switched to the neutral shift position.

The control section may control the actuator as follows when performing the above-described shift switching operation in a case where the vessel speed is equal to or higher than the predetermined value. Specifically, the control section may increase the pressing load to be applied to the rotating member by the contact member when the shift position in the forward-reverse switching mechanism is switched to the neutral shift position. The control section may keep the increased pressing load until the shift position is switched to the forward (or reverse) shift position.

Alternatively, the control section may control the actuator as follows when performing the above-described shift switching operation in a case where the vessel speed is equal to or higher than the predetermined value. Specifically, the control sectionmay increase the pressing load to be applied to the rotating member by the contact member when the shift position is switched to the neutral shift position in the forward-reverse switching mechanism. The control section may reduce the increased pressing load at a timing at which the shift position is switched to the forward (or reverse) shift position.

The control section may control the actuator as follows when performing the above-described shift switching operation in a case where the vessel speed of the vessel is lower than a predetermined value. Specifically, the control section may control the actuator so that the pressing load to be applied to the rotating member by the contact member becomes constant regardless of the operation position of the operation member.

Another preferred embodiment of the present invention provides a vessel including a hull, a vessel propulsion device attached to the hull, and a remote control device including any of the features described above.

Still another preferred embodiment of the present invention provides a method for remotely controlling a vessel propulsion device installed in a vessel by a remote control device that performs shift position switching. This method includes a step of detecting a vessel speed of the vessel and a step of controlling the operation load of the operation member in the remote control device based on the detected vessel speed.

In the above-described method, in the step of controlling the operation load of the operation member, when performing an operation to switch the shift position in a case where the vessel speed is equal to or higher than a predetermined value, the operation load may be controlled as follows. Specifically, the operation load may be controlled so that a maximum operation load of the operation member in a predetermined shift position switching operation range becomes larger than a maximum operation load of the operation member out of the predetermined shift position switching operation range.

In the step of controlling the operation load of the operation member, when performing a shift switching operation by the operation member in a case where the vessel speed is lower than a predetermined value, the pressing load to be applied to a contact member to press the contact member against the operation member may be controlled to be constant regardless of the position of the operation member.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
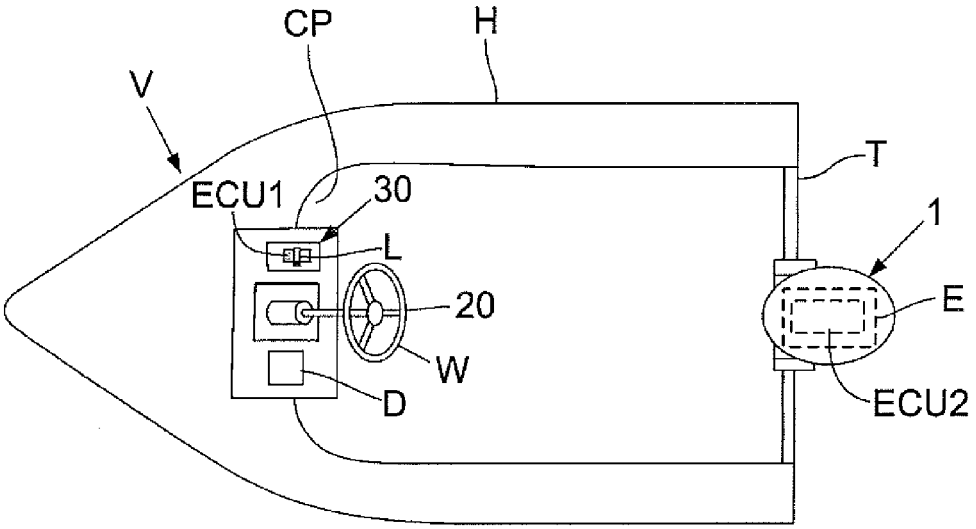
FIG. 1 is a plan view showing a schematic arrangement of a vessel including a remote control device for a vessel according to a preferred embodiment of the present invention.

FIG. 1 shows a schematic arrangement of a vessel according to a preferred embodiment of the present invention.

A vessel V includes a hull H. A vessel propulsion device 1 is attached to the tail T of the hull H. In the present preferred embodiment, the vessel propulsion device 1 preferably is an outboard motor, for example. The outboard motor 1 applies thrust to the hull H. A steering member 20, a remote control device 30, and a display section D are installed in the cockpit CP of the hull H.

The steering member 20 includes a steering wheel W. According to a rotating operation of the steering wheel W, the direction of the outboard motor 1 attached to the tail T of the hull H is changed in the right-left direction, and accordingly, the traveling direction of the hull H is changed.

The remote control device 30 is a device to be operated by an operator to remotely control, from the cockpit CP, the outboard motor 1, etc., provided on the tail T. The display section D displays various information, for example, the vessel speed of the vessel V, the operation state of the remote control device 30, and drive information of the outboard motor 1, etc.

Figure 2:
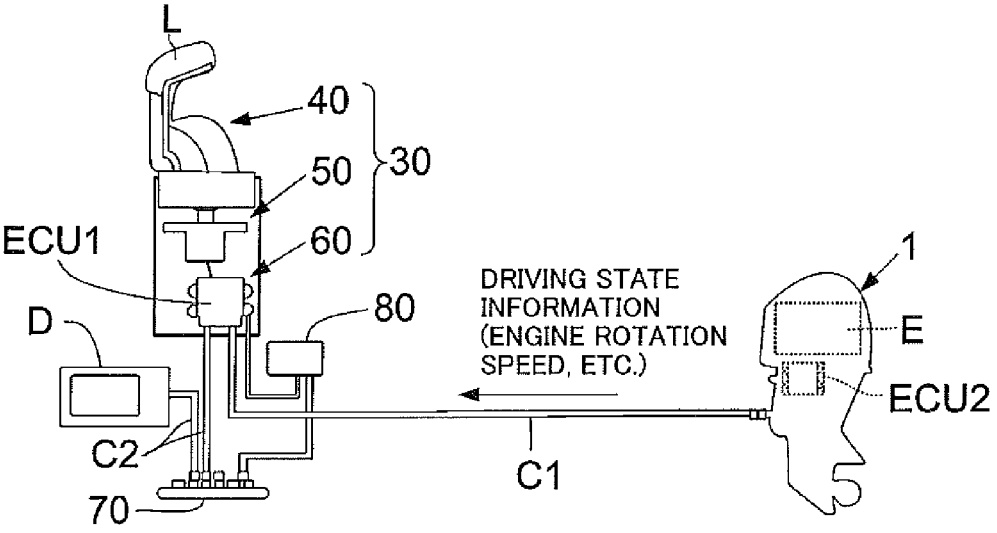
FIG. 2 is an explanatory view showing an outline of a control system of the remote control device.

FIG. 2 shows an outline of a control system including the remote control device 30. This control system includes the outboard motor 1 and the remote control device 30. The remote control device 30 includes an operation section 40, an operation load applying mechanism 50, and a control section 60. The operation section 40 includes an operation lever L. The operation load applying mechanism 50 is arranged to apply an operation load to the operation lever L. The control section 60 is programmed to control the operation load of the operation lever L. In detail, the control section 60 includes a first electronic control unit ECU 1. The control section 60 is connected to the outboard motor 1 via a communication cable C1. The control section 60 is connected to the display section D via a communication cable C2. In FIG. 2, the reference symbol 70 denotes a hub, and the reference symbol 80 denotes a switch panel.

The control system functions so that when an operator operates the operation section 40 of the remote control device 30, for example, the rotation speed of the engine E of the outboard motor 1 is changed and the thrust generating direction of the outboard motor 1 switches between forward and reverse. Driving state information such as the rotation speed of the engine E of the outboard motor 1 is input into the control section 60 of the remote control device 30 via the communication cable C1. The control section 60 controls the operation load applying mechanism 50, according to a program stored in advance, based on the input information.

Figure 3:
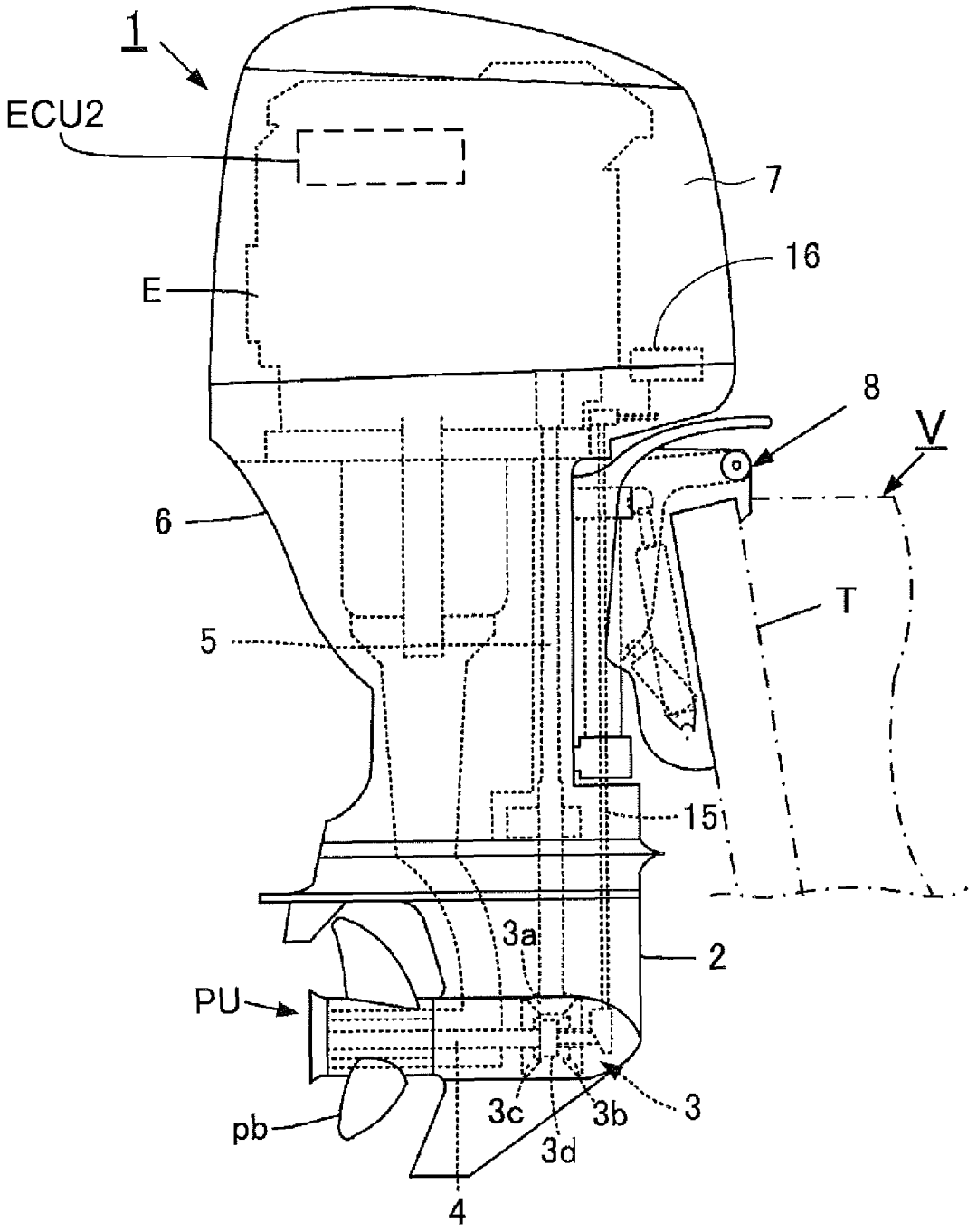
FIG. 3 is a side view of an outboard motor.

FIG. 3 is a side view of the outboard motor 1. The outboard motor 1 includes a lower casing 2 on the lower portion. A propeller unit PU including a plurality of propeller blades pb is attached to the lower casing 2. A forward-reverse switching mechanism 3 and a propeller shaft 4 are provided inside the lower casing 2. An upper casing 6 is fixed onto the lower casing 2. A drive shaft 5 is disposed to extend in the up-down direction inside the upper casing 6. An engine cover 7 is attached onto the upper casing 6. The engine E is housed inside the engine cover 7. The outboard motor 1 includes a second electronic control unit ECU 2 that controls the engine E, etc. This outboard motor 1 is attached to the tail T of the vessel V via amounting device 8.

The torque of the engine E is transmitted to the forward-reverse switching mechanism 3 inside the lower casing 2 via the drive shaft 5 disposed inside the upper casing 6. The drive force transmitted to the forward-reverse switching mechanism 3 is transmitted to the propeller blades pb via the propeller shaft 4. The rotating direction of the propeller shaft 4, that is, the rotating direction of the propeller blades pb is switched by the forward-reverse switching mechanism 3.

The forward-reverse switching mechanism 3 includes a drive gear 3*a* in the form of a bevel gear fixed to the lower end of the drive shaft 5. The forward/reverse switching mechanism 3 includes a forward gear 3*b* and a reverse gear 3*c*. The forward gear 3*b* and the reverse gear 3*c* are attached to the propeller shaft 4 rotatably around the propeller shaft 4. Further, the forward/reverse switching mechanism 3 includes a dog clutch 3*d* disposed between the forward gear 3*b* and the reverse gear 3*c*.

The dog clutch 3*d* is spline-coupled to the propeller shaft 4. Specifically, the dog clutch 3*d* is movable in the axial direction of the propeller shaft 4. However, the dog clutch 3*d* cannot rotate relative to the propeller shaft 4 in the circumferential direction of the propeller shaft.

A shift rod 15 is disposed to extend in the up-down direction parallel or substantially parallel to the drive shaft 5. The shift rod 15 is driven to rotate by a drive unit 16 disposed on the upper portion of the shift rod 15. According to a rotary drive of the shift rod 15, the dog clutch 3*d* moves along the axial direction of the propeller shaft 4. According to this axial movement, the position of the dog clutch 3*d* is switched among a forward shift position at which the dog clutch engages with the forward gear 3*b*, a reverse shift position at which the dog clutch 3*d* engages with the reverse gear 3*c*, and a neutral shift position at which the dog clutch engages with neither of the gears 3*b*, 3*c*. Specifically, the position of the dog clutch 3*d* corresponds to the shift position of the outboard motor 1.

When the dog clutch 3*d* is at the forward shift position, rotation of the forward gear 3*b* is transmitted to the propeller shaft 4 via the dog clutch 3*d*. According to the rotation of the propeller shaft 4, the propeller blades pb generate thrust in a direction to make the vessel V travel forward. On the other hand, when the dog clutch 3*d* is at the reverse shift position, the rotation of the reverse gear 3*c* is transmitted to the propeller shaft 4 via the dog clutch 3*d*. The reverse gear 3*c* rotates in a direction opposite to the rotating direction of the forward gear 3*b*, so that the propeller shaft 4 rotates reversely. Therefore, the propeller blades pb generate thrust in a direction to make the vessel V travel in the opposite direction, that is, in reverse. When the dog clutch 3*d* is at the neutral shift position, the dog clutch 3*d* engages with neither of the forward gear 3*b* nor the reverse gear 3*c*. Therefore, the rotary drive force of the drive shaft 5 is not transmitted to the propeller shaft 4. Accordingly, the propeller blades pb rotate in neither of the directions, and generate thrust in neither of the directions.

When the dog clutch 3*d* engages with either of the forward gear 3*b* or the reverse gear 3*c* according to a rotary driving of the shift rod 15 from the state where the dog clutch 3*d* engages with neither of the forward gear 3*b* nor the reverse gear 3*c*, an impact is generated. The impact occurs since relative rotation occurs between the dog clutch 3*d* that rotates together with the propeller shaft 4 and the forward gear 3*b* or reverse gear 3*c* that rotates according to rotation of the drive shaft 5. The magnitude of this impact is larger during high-speed traveling of the vessel V than during low-speed traveling. This is because the speed of the relative water flow around the propeller unit PU is high, and the propeller shaft 4 rotates at a high speed due to this water flow.

The forward-reverse switching mechanism 3 is remotely controlled by the remote control device 30. Specifically, when the operation section 40 of the remote control device 30 is operated, a command corresponding to the operation angle is input into the second electronic control unit ECU 2 of the engine E via the first electronic control unit ECU 1 of the remote control device 30. The second electronic control unit ECU 2 outputs a command to the drive unit 16. Accordingly, the shift rod 15 is driven to rotate, and the shift position in the forward-reverse switching mechanism 3 is switched. Thus, an operator can change the shift position of the forward-reverse switching mechanism 3 by just operating the remote control device 30, and accordingly, can switch the rotating direction of the propeller blades pb.

The remote control device 30 includes the operation lever L to be operated by an operator. The operation lever L is an example of the operation member according to a preferred embodiment of the present invention. The operation lever L preferably includes, in the present preferred embodiment, one lever member, for example. An operator can perform an operation to adjust the rotation speed of the engine E and a shift switching operation by operating this single lever member.

Figure 4:
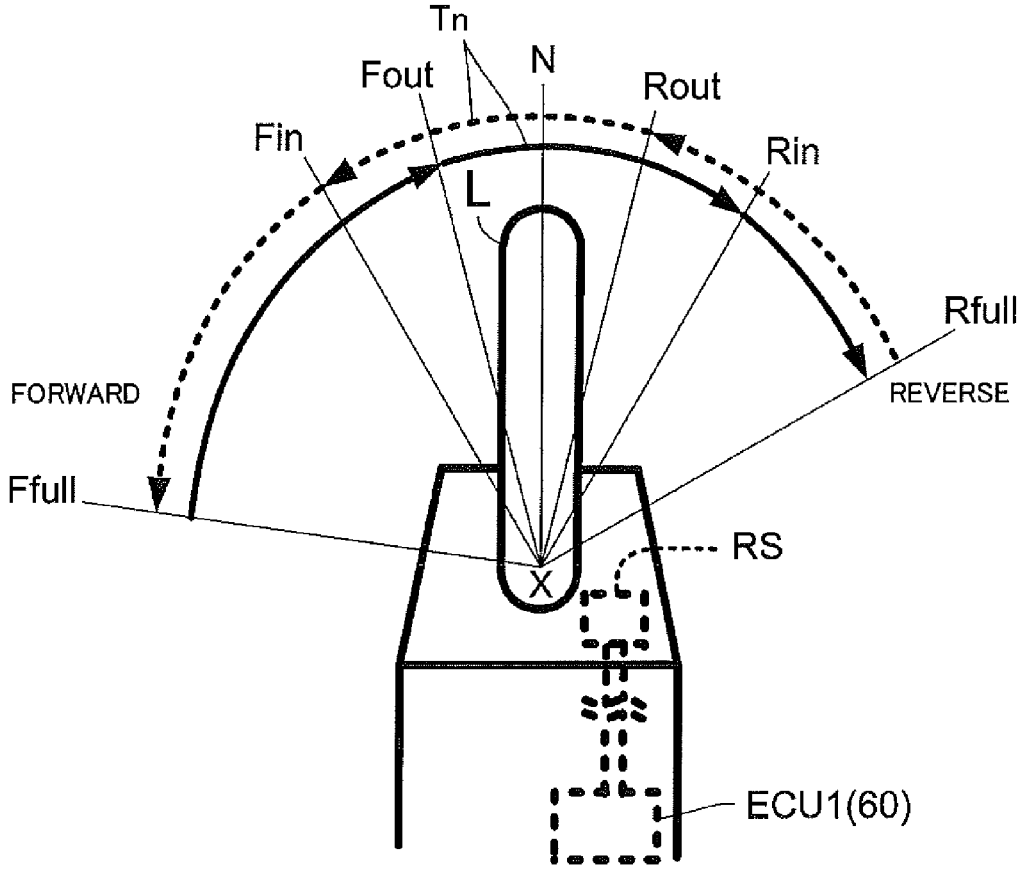
FIG. 4 is an explanatory view of an operation of an operation lever.

Next, an operation with the operation lever L is described. Here, it is assumed that the engine E is operating. As shown in FIG. 4, for example, when the operation lever L is at the neutral position N at which the operation lever is erect substantially vertically, the shift position in the forward-reverse switching mechanism 3 is controlled to be in the neutral shift position. Specifically, the dog clutch 3*d* engages with neither of the forward gear 3*b* nor the reverse gear 3*c*. Therefore, the propeller blades pb are not rotated by the engine E.

From this state, when the operation lever L is inclined forward (counterclockwise in FIG. 4) to the forward shift-in position Fin, the shift position of the forward-reverse switching mechanism 3 switches to the forward shift position. Specifically, the dog clutch 3*d* engages with the forward gear 3*b*. Therefore, the propeller blades pb rotate in a direction to make the hull H travel forward.

From this state, when the operation lever L is further inclined forward, the rotation speed of the engine E increases according to the inclination of the operation lever L. The operation lever L can be operated rotatably to the forward full-open position Ffull that is the forefront position.

On the other hand, when the operation lever L is returned toward the neutral position N from the above-described forward-inclined state, the rotation speed of the engine E decreases. When the operation lever L is returned to the forward shift-out position Fout, the shift position in the forward-reverse switching mechanism 3 switches from the forward shift position to the neutral shift position. Specifically, the dog clutch 3*d* and the forward gear 3*b* are disengaged from each other, and the dog clutch 3*d* engages with neither of the forward gear 3*b* nor the reverse gear 3*c*.

On the other hand, when the operation lever L is inclined reversely (clockwise in FIG. 4) from the neutral position N at which the operation lever L is erect vertically or substantially vertically relative to the reverse shift-in position Rin, the shift position in the forward-reverse switching mechanism 3 switches from the neutral shift position to the reverse shift position. Specifically, the dog clutch 3*d* engages with the reverse gear 3*c*. Therefore, the propeller blades pb rotate in a direction to make the hull H travel in reverse.

From this state, when the operation lever L is further inclined reversely, the rotation speed of the engine E increases according to the inclination of the operation lever L. The operation lever L can be operated rotatably to the reverse full-open position Rfull that is the rearmost position.

On the other hand, when the operation lever L is returned toward the neutral position N from the above-described reversely-inclined state, the rotation speed of the engine E decreases. When the operation lever L is returned to the reverse shift-out position Rout, the shift position in the forward-reverse switching mechanism 3 switches from the reverse shift position to the neutral shift position. Specifically, the dog clutch 3*d* and the reverse gear 3*c* are disengaged from each other, and the dog clutch 3*d* is put into a state where it engages with neither of the forward gear 3*b* nor the reverse gear 3*c*.

As shown in FIG. 4, depending on the operating direction of the operation lever L, the neutral range Tn of the operation lever L in which the shift position is the neutral shift position differs. As is clear from FIG. 4, regardless of the operating direction of the operation lever L, when the operation lever L is between the forward shift-out position Fout and the reverse shift-out position Rout, the shift position is always at the neutral shift position. Specifically, the dog clutch 3*d* is in a state where it engages with neither of the forward gear 3*b* nor the reverse gear 3*c*. The control system according to the present preferred embodiment performs control so that, in the range in which the shift position is always at the neutral position, the operation load of the operation lever L increases when the vessel speed is high as described hereinafter.

In the present preferred embodiment, by operating the single operation lever L, the operation to adjust the rotation speed of the engine E (adjust the throttle opening degree of the engine E and, eventually, adjust the speed of the vessel V) and a shift switching operation by the forward-reverse switching mechanism 3 are performed.

Preferred embodiments of the present invention are not limited to the above-described arrangement. For example, another preferred embodiment of present invention may also include an arrangement in which the operation to adjust the rotation speed of the engine E and the shift switching operation by the forward-reverse switching mechanism 3 are performed separately by two operation members (operation levers). In this case, the above-described control is applied to the operation member (operation lever) that performs the shift switching operation. In the present preferred embodiment, the remote control device 30 is connected (wired connection) to the vessel propulsion device (outboard motor) 1 by the communication cable C1. However, the remote control device 30 may be connected, for example, wirelessly to the vessel propulsion device (outboard motor) 1 (wireless network connection).

Figure 5:
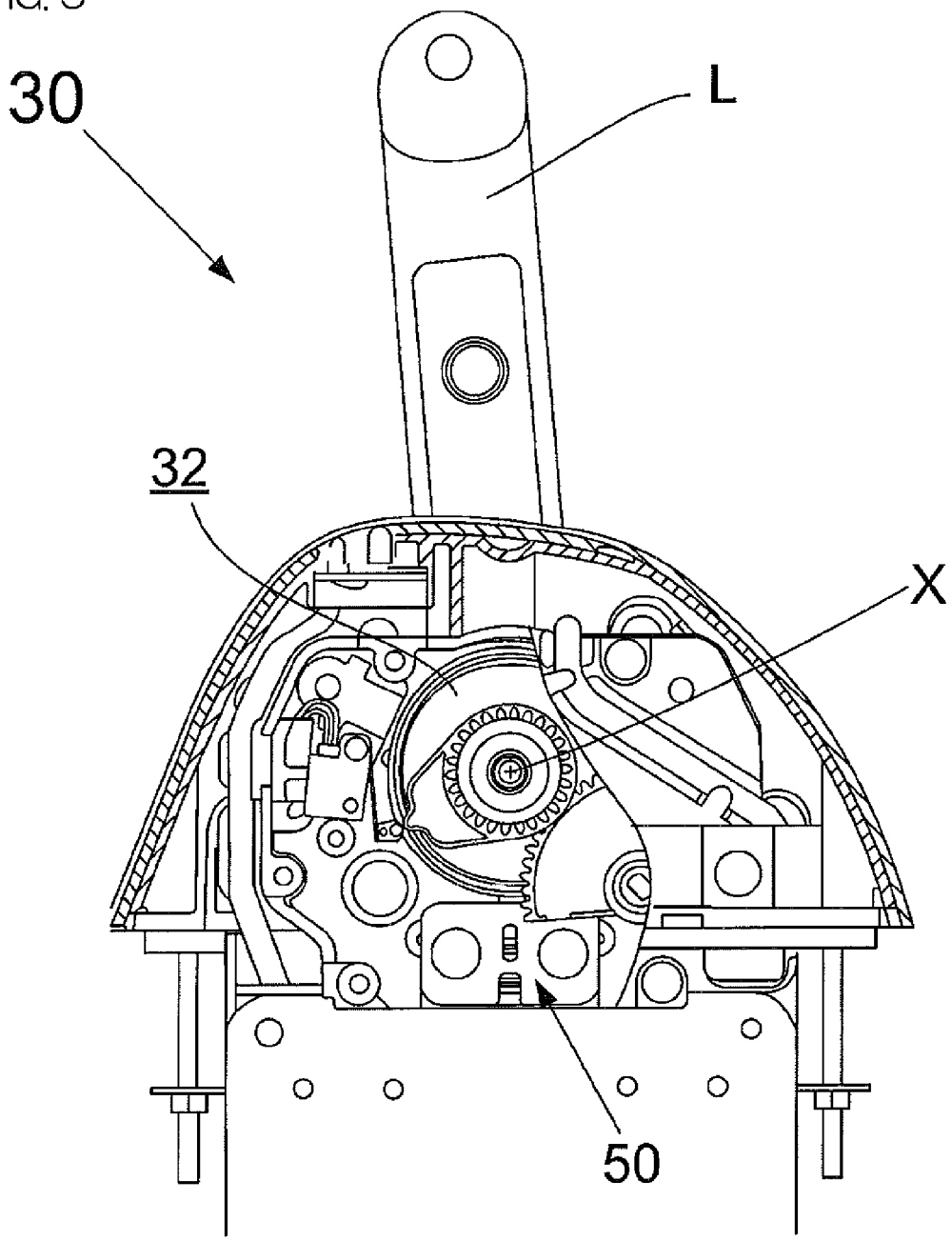
FIG. 5 is a longitudinal sectional view of the remote control device.
Figure 6:
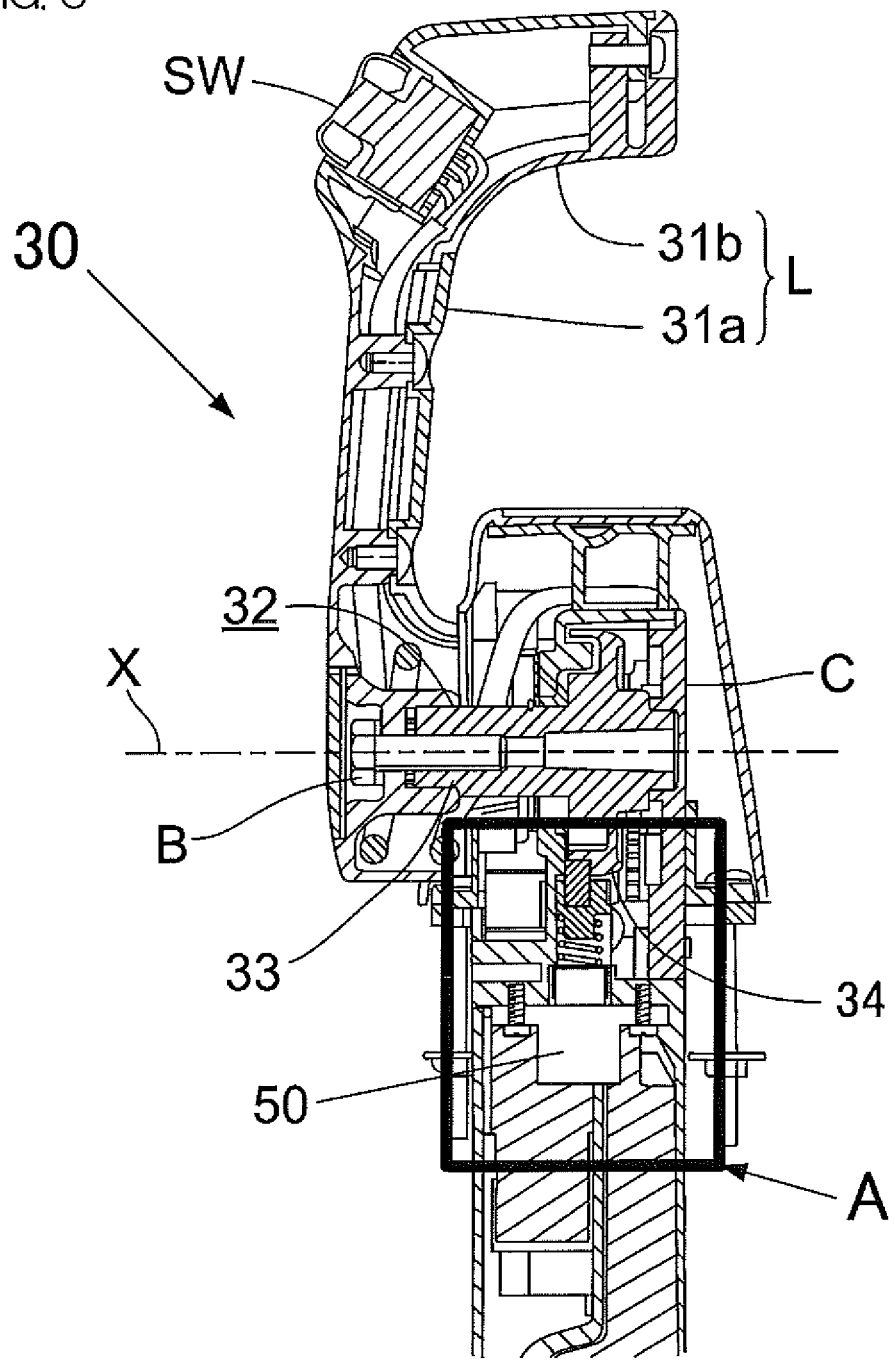
FIG. 6 is a longitudinal sectional view of the remote control device taken along the operation lever.

Next, the arrangement of the remote control device 30 is described. As shown in FIG. 5, the remote control device 30 preferably includes a single operation lever L. The operation lever L is rotatable in a predetermined angle range around the rotation axis X on the lower end portion. The operation lever L includes a lever main body portion 31*a* extending in a direction away from the rotation axis X as shown in FIG. 6. From the upper portion of the lever main body portion 31*a*, a grip portion 31*b* extends integrally in the horizontal direction along the rotation axis X. To the base end portion of the grip portion 31*b*, a switch SW that controls the mounting device 8 for the outboard motor 1 is attached.

To the lower end portion of the lever main body portion 31*a* of the operation lever L, a rotating member 32 extending along the rotation axis X is fixed by a bolt B. The rotating member 32 is attached to a casing member C in a manner enabling the rotating member 32 to rotate around the rotation axis X.

The rotating member 32 includes a shaft portion 33 extending along the rotation axis X, and a large diameter portion 34 having a relatively large radius and integral with the shaft portion 33 on one end side (the right side of FIG. 6) of the shaft portion 33.

When the operation lever L is rotated around the rotation axis X, the rotating member 32 rotates accordingly. In the present preferred embodiment, as described below, a pressing load to be applied to the rotating member 32 is controlled. In another preferred embodiment of the present invention, it is also possible that a pressing load is applied to another rotating member that rotates in conjunction with the rotating member 32, and this pressing load is controlled.

The remote control device 30 includes a rotation sensor RS (refer to FIG. 4) that detects a rotation angle of the rotating member 32 and, eventually, the operation angle of the operation lever L. A detection signal from the rotation sensor RS is input into the first electronic control unit ECU 1 of the control section 60. Based on this detection signal, the first electronic control unit ECU 1 generates a control signal, and outputs this control signal to the second electronic control unit ECU 2 for the engine of the outboard motor 1. The second electronic control unit ECU 2 controls the rotation speed of the engine E based on the control signal. The second electronic control unit ECU 2 also controls shift switching of the forward-reverse switching mechanism 3 based on the control signal.

On the other hand, the second electronic control unit ECU 2 of the outboard motor 1 collects information such as the rotation speed of the engine E and transmits the information to the first electronic control unit ECU 1 of the remote control device 30 via the communication cable C1 as shown in FIG. 2. Then, the first electronic control unit ECU 1 controls the operation load applying mechanism 50 based on the information from the second electronic control unit ECU 2. Accordingly, the operation load of the operation lever L of the operation section 40 is controlled.

Figure 7:
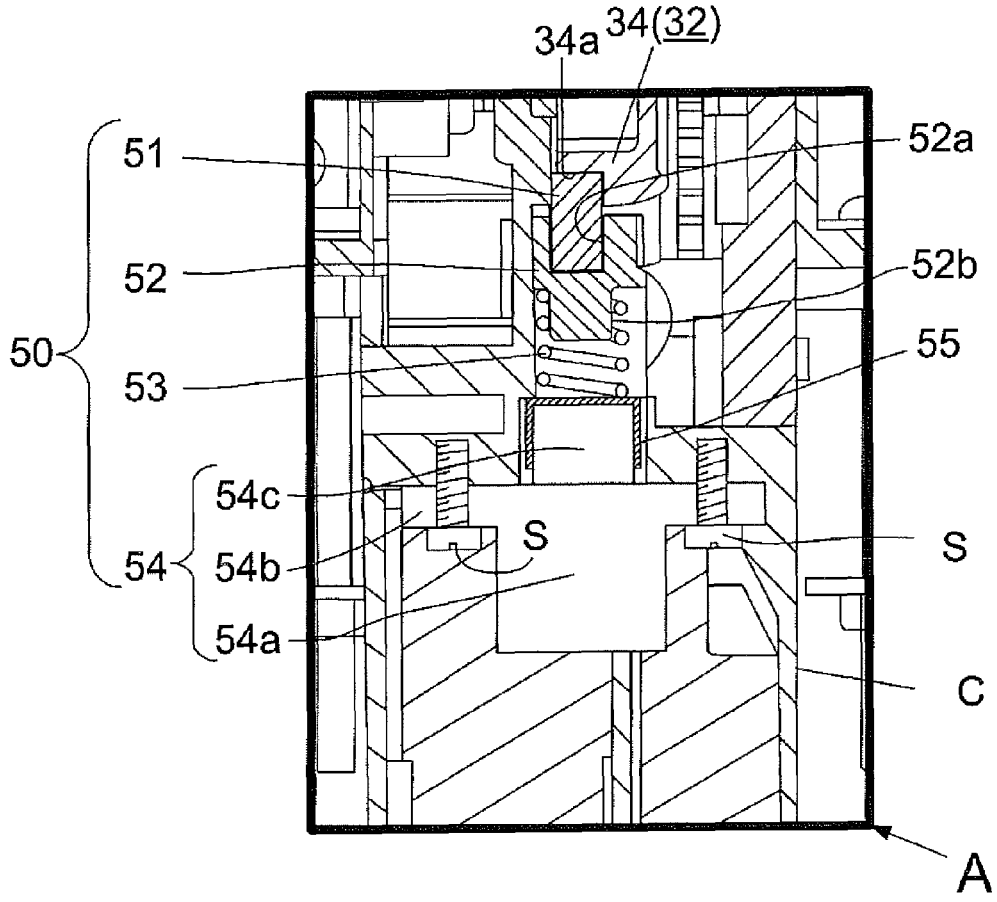
FIG. 7 is an enlarged sectional view of the boxed portion A in FIG. 6.

As shown in FIG. 5, the operation load applying mechanism 50 that applies an operation load to the operation lever L is arranged below the rotating member 32. The operation load applying mechanism 50 includes, as shown in an enlarged manner in FIG. 7, a detent roller 51, a roller presser member 52, a detent spring 53, and an actuator 54. The detent roller 51 is an example of the contact member in a preferred embodiment of the present invention. The detent spring 53 is an example of the elastic member in a preferred embodiment of the present invention.

The detent roller 51 is arranged in contact with the outer peripheral surface 34*a* of the large diameter portion 34 of the rotating member 32. The detent roller 51 preferably includes a columnar member including an axis extending parallel or substantially parallel to the rotation axis X. The detent roller 51 is fit into a recess 52*a* provided on the upper portion of the roller presser member 52 while being rotatable around the axis thereof. The cylindrical outer peripheral surface of the detent roller 51 is preferably a rolling surface that rolls on the outer peripheral surface 34*a* of the large diameter portion 34 of the rotating member 32. The detent roller 51 is an example of the rolling member that moves while rolling on the outer peripheral surface 34*a* of the rotating member 32 according to rotation of the rotating member 32 around the rotation axis X.

The roller presser member 52 preferably includes a columnar projection 52*b* on the lower end. The upper end portion of the detent spring 53 preferably defined by a coil spring is fit on the projection 52*b*. The actuator 54 is disposed under the detent spring 53.

The actuator 54 includes a main body portion 54*a* and a flange portion 54*b* that projects outward on the periphery of the upper end of the main body portion 54*a*. The flange portion 54*b* is preferably fixed to the casing member C by a plurality of screws S, for example. The actuator 54 further includes a movable portion 54*c* projecting upward from the upper end surface of the main body portion 54*a* in a manner enabling the movable portion 54*c* to move up and down. A tubular bushing member 55 is fit to the movable portion 54*c*. The bushing member 55 is in contact with the lower end of the detent spring 53.

The detent roller 51 is always pressed against the outer peripheral surface 34*a* of the large diameter portion 34 of the rotating member 32 by the detent spring 53 via the roller presser member 52. The detent roller 51 moves while rolling on the outer peripheral surface 34*a* of the large diameter portion 34 when the large diameter portion 34 of the rotating member 32 rotates around the rotation axis X.

The large diameter portion 34 of the rotating member 32 preferably has the shape of a circle as viewed from the rotation axis X direction. Therefore, regardless of the rotating position of the operation lever L, the pressing force of the detent roller 51 is constant.

The movable portion 54*c* of the actuator 54 projects upward by a predetermined amount from the main body portion 54*a* when the actuator 54 is not actuated. When the actuator 54 is actuated, the movable portion 54*c* further projects toward the detent roller 51. When the actuator 54 is actuated and the movable portion 54*c* further projects, the detent spring 53 is compressed by an amount corresponding to the projection. Therefore, the pressing load of the detent roller 51 (hereinafter, this pressing load is referred to as a "detent load") against the outer peripheral surface 34*a* of the large diameter portion 34 of the rotating member 32 increases.

As the actuator 54, a solenoid type that actuates the movable portion 54*c* by a solenoid is preferably used. The solenoid type actuator 54 can keep the load small even when it malfunctions since the movable portion 54*c* returns to the original position (non-actuating position). Of course, in another preferred embodiment of the present invention, the actuator 54 may include, for example, a motor.

In the present preferred embodiment, as a contact member that is in contact with the peripheral surface of the rotating member 32, the columnar detent roller 51 is preferably used, for example. However, in another preferred embodiment of the present invention, as the contact member, any other rolling members such as a cylindrical member or a spherical member can be used, or a member that does not roll on the peripheral surface of the rotating member 32 may be used.

Figure 8:
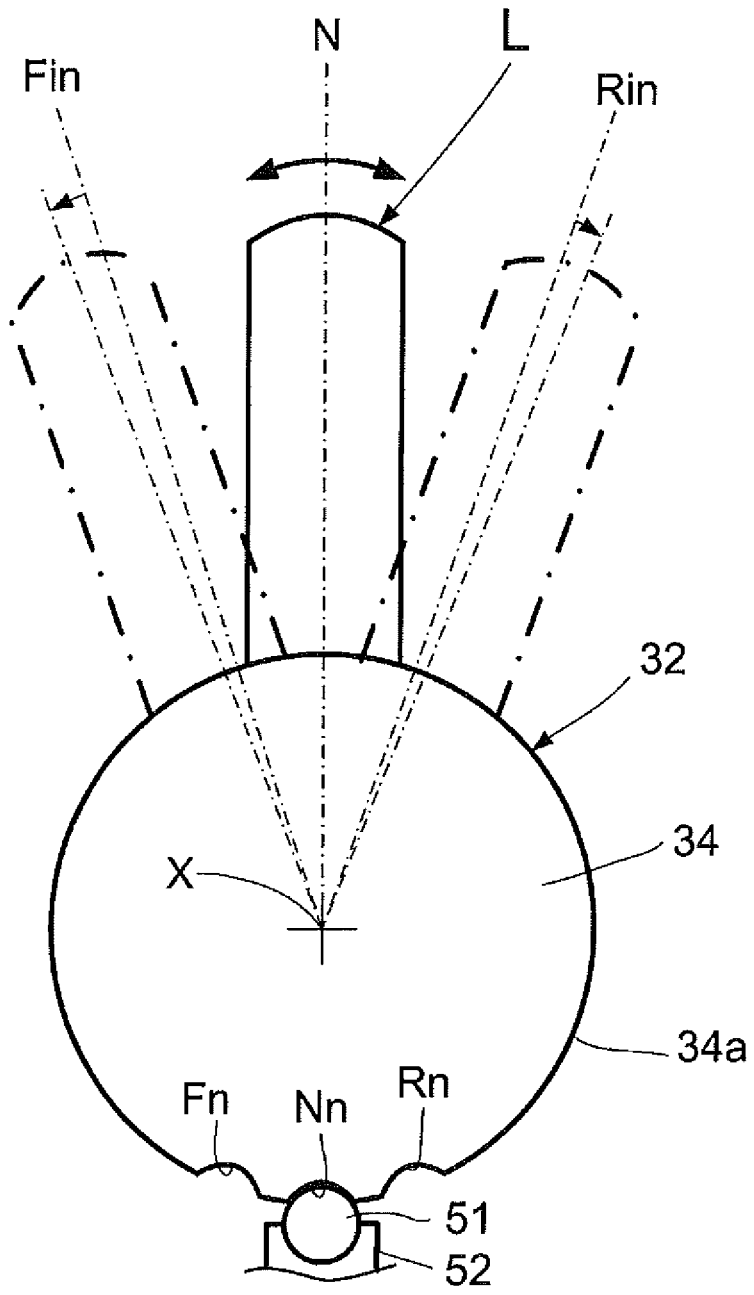
FIG. 8 is an explanatory view showing recess positions on a rotating member of the remote control device.

In the present preferred embodiment, as shown in FIG. 8, notches Nn, Fn, and Rn formed by a plurality of recesses are provided on the outer peripheral surface 34*a* of the large diameter portion 34 of the rotating member 32. In detail, in the present preferred embodiment, three notches including a neutral notch Nn, a forward notch Fn, and a reverse notch Rn preferably are provided. In these notches Nn, Fn, and Rn, the detent roller 51 as a contact member selectively fits in a manner enabling the detent roller to come out therefrom according to rotation of the rotating member 32. When the detent roller 51 fits in any of the notches Nn, Fn, and Rn, a feeling of the notch is applied to the operation lever L, and the operation lever L is temporarily held at a predetermined position corresponding to the notch Nn, Fn, or Rn.

The dimensions and shapes of the notches Nn, Fn, and Rn are set so that the detent roller 51 fits therein in a manner enabling the detent roller 51 to come out therefrom. In the present preferred embodiment, the notches Nn, Fn, and Rn preferably have arc shapes in section. However, for example, notches having V shapes in section may also be used.

In the present preferred embodiment, the neutral notch Nn is located at a position at which the detent roller 51 fits therein when the operation lever L is at the neutral position N. The forward notch Fn is located at a position at which the detent roller 51 fits therein when the operation lever L is at a position slightly over the forward shift-in position Fin toward the forward side. The reverse notch Rn is located at a position at which the detent roller 51 fits therein when the operation lever L is at a position slightly over the reverse shift-in position Rin toward the reverse side.

The detent roller 51 is arranged to move while rolling on the outer peripheral surface 34*a* of the large diameter portion 34 of the rotating member 32. Therefore, even when the detent load changes, at a position other than the positions corresponding to the notches, the operation load of the operation lever L is at a constant or substantially constant small value. However, when the detent load increases or decreases, according to this, the operation load of the operation lever L necessary for the detent roller 51 fitting in the notch Nn, Fn, or Rn at the position at which the notch Nn, Fn, or Rn is provided to come out from the notch increases or decreases.

Figure 9:
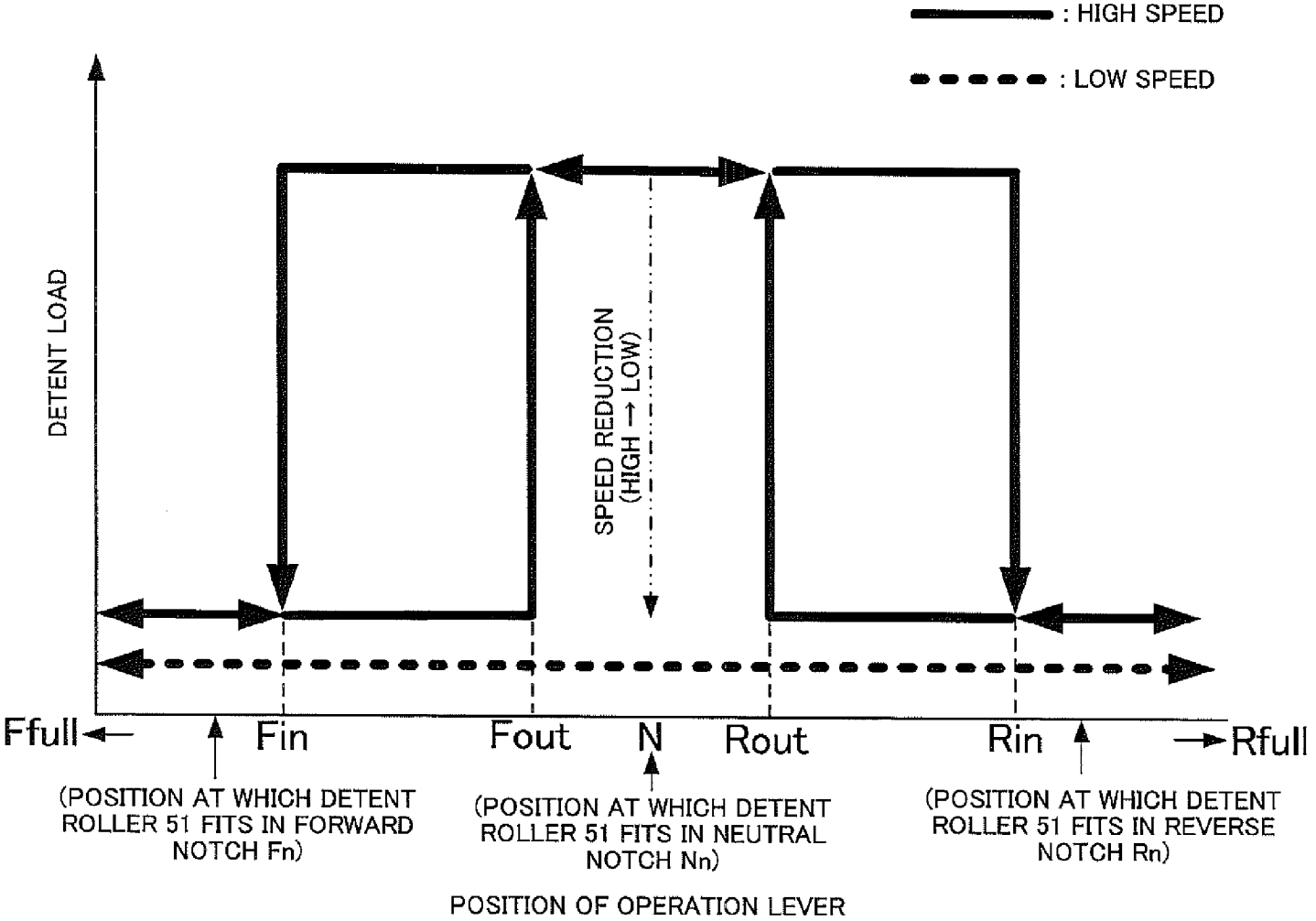
FIG. 9 is a graph showing an example of control of a detent load with respect to the position of the operation lever.

Next, control of the operation load of the operation lever L is described. In FIG. 9, the vertical axis shows the magnitude of the detent load, and the horizontal axis shows the position of the operation lever L.

Figure 10A:
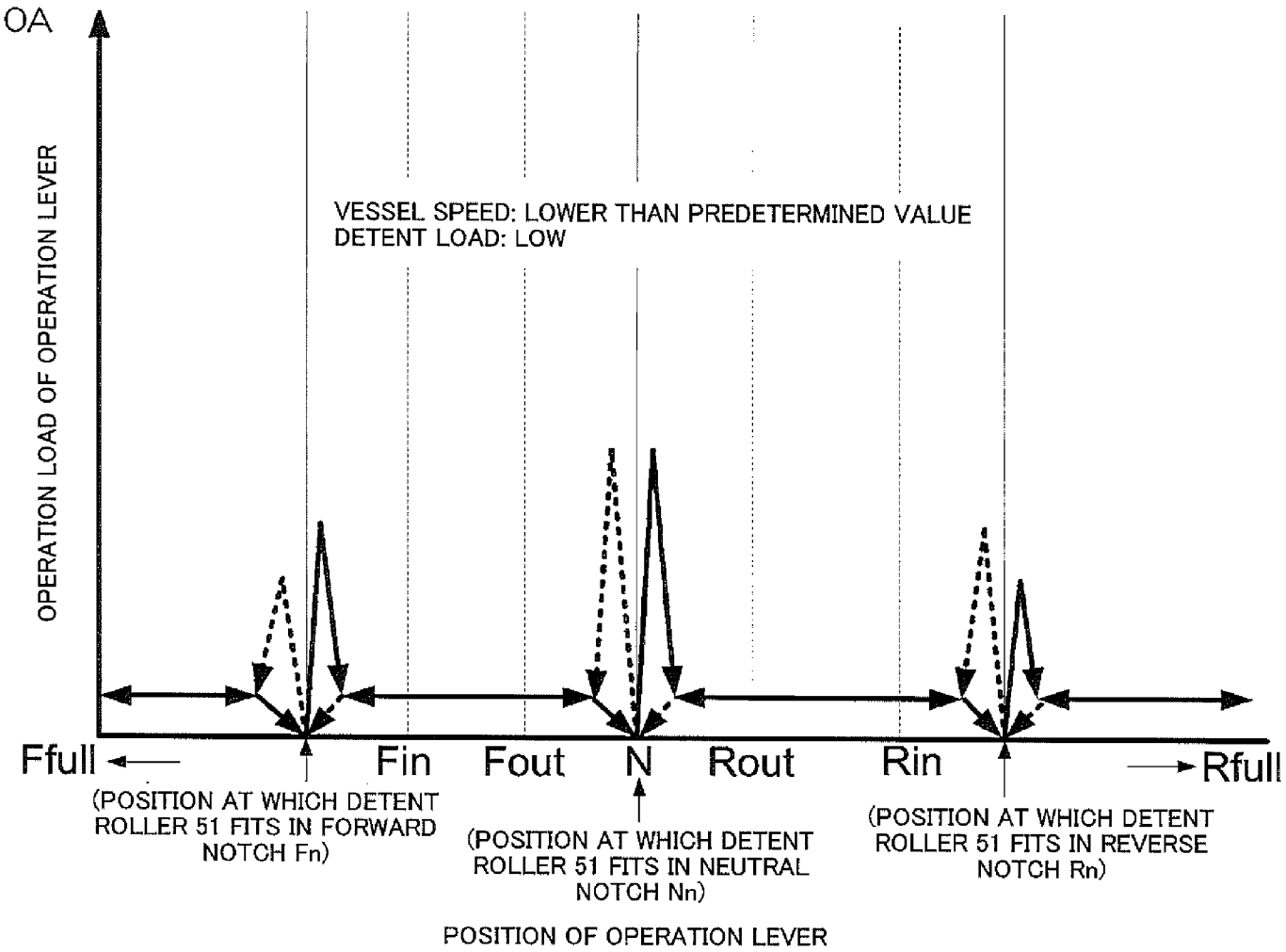
FIG. 10A is a graph showing a relationship between the position of the operation lever and the operation load in a case where the vessel speed is lower than a predetermined value.
Figure 10B:
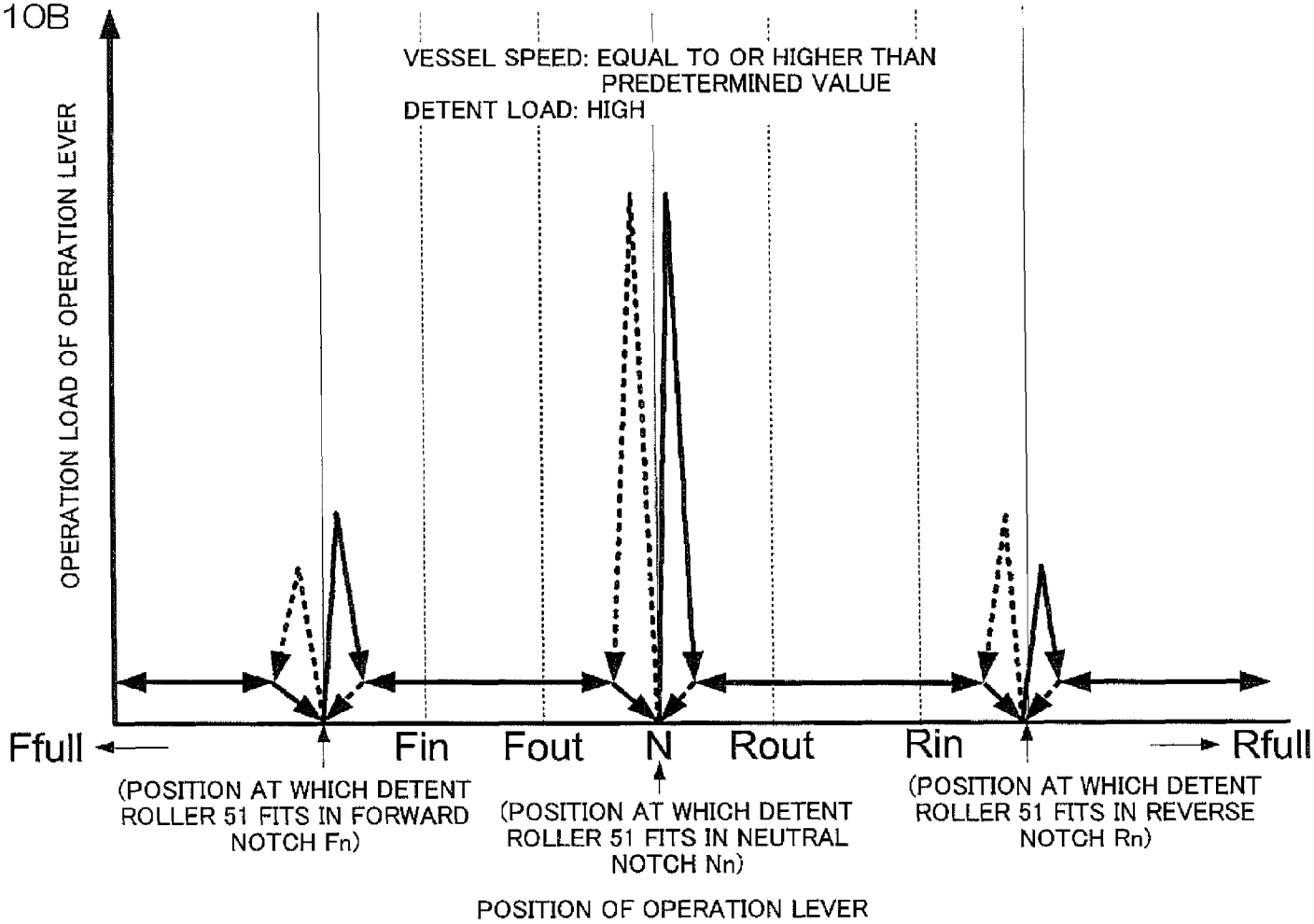
FIG. 10B is a graph showing a relationship between the position of the operation lever and the operation load in a case where the vessel speed is equal to or higher than the predetermined value.

In the present preferred embodiment, the detent load is controlled as shown in FIG. 9 by controlling the actuator 54. By this control, as shown in FIG. 10A and FIG. 10B, the operation load of the operation lever L necessary for the detent roller 51 fitting in the notch Nn, Fn, or Rn to come out from the notch is changed. Hereinafter, control of the operation load of the operation lever L is described in detail.

On the horizontal axis of FIG. 9 showing the position of the operation lever L, the right side of the neutral position N corresponds to the case where the operation lever L is inclined to the reverse side (clockwise in FIG. 4). The left side of the neutral position N corresponds to the case where the operation lever L is inclined to the forward side (counterclockwise in FIG. 4). The thick solid line shows control of the detent load when the vessel speed of the vessel V is equal to or higher than a predetermined value. On the other hand, the bold dashed line shows control of the detent load when the vessel speed of the vessel V is smaller than the predetermined value.

In FIG. 9, to avoid overlap of the lines, the detent load when the vessel speed of the vessel V is smaller than the predetermined value is shown to be smaller than the smallest value of the detent load when the vessel speed of the vessel V is equal to or higher than the predetermined value. However, these values may be equal to each other. Further, in the preferred embodiment shown in FIG. 9, two patterns where the speed is high and the speed is low are illustrated. However, the detent load may be further changed according to a plurality of different vessel speeds. In this case, it is preferable that the set detent load becomes larger as the vessel speed becomes higher.

Control of the operation load of the operation lever L is performed as follows. First, the second electronic control unit ECU 2 installed in the outboard motor 1 detects the rotation speed of the engine E. Then, the second electronic control unit ECU 2 transmits the information on the detected engine rotation speed to the first electronic control unit ECU 1 of the remote control device 30 via the communication cable C1. The first electronic control unit ECU 1 that has received this information determines whether the rotation speed of the engine E is lower than the predetermined engine rotation speed. On the other hand, a rotation sensor RS detects the operation angle of the operation lever L. This detection signal is input into the first electronic control unit ECU 1. Then, based on a program stored in advance, the first electronic control unit ECU 1 controls the actuator 54 according to the vessel speed and the position (operation angle) of the operation lever L.

First, a case where the vessel V travels at a speed lower than the predetermined vessel speed is assumed.

In this case, the first electronic control unit ECU 1 determines that the rotation speed of the engine E is lower than the predetermined engine rotation speed. Then, regardless of the position (operation angle) of the operation lever L, the first electronic control unit ECU 1 keeps the actuator 54 in an off state. Accordingly, as shown by the dashed line in FIG. 9, the detent load is kept at a constant low value regardless of the position (operation angle) of the operation lever L.

FIG. 10A shows a relationship between the position of the operation lever L and the operation load when the vessel speed is lower than the predetermined value. Corresponding to the position at which the detent roller 51 fits in the forward notch Fn, the neutral notch Nn, or the reverse notch Rn, the operation load of the operation lever L increases. The operation load necessary for each notch position is set according to the strength of the detent spring 53 and the shape and depth, etc., of each notch Fn, Nn, and Rn. The shapes of the notches may be asymmetrical about the circumferential direction of the outer peripheral surface 34*a* so that the operation loads of the operation lever L at the positions at which the detent roller 51 fits in the forward notch Fn and the reverse notch Rn differ depending on the lever operating direction.

Next, the case where the vessel V travels at a high speed equal to or higher than the predetermined vessel speed is assumed.

In this case, as in the case described above, the first electronic control unit ECU 1 determines whether the engine rotation speed is equal to or higher than a predetermined value. When it is determined that the engine rotation speed is equal to or higher than the predetermined engine rotation speed, the first electronic control unit ECU 1 controls the actuator 54 according to the position (operation angle) of the operation lever L as shown by the solid line in FIG. 9.

As shown in FIG. 9, when the operation lever L is positioned in a range between the position Ffull and the position Fin (including the position at which the detent roller 51 fits in the forward notch Fn), control is performed to keep the detent load low. Also, when the operation lever L is positioned in a range between the position Rin and the position Rfull (including the position at which the detent roller 51 fits in the reverse notch Rn), control is performed to keep the detent load low. On the other hand, when the operation lever L is positioned in a range between the position Fout and the position Rout (including the position at which the detent roller 51 fits in the neutral notch Nn), control is performed to increase the detent load to a high value by driving the actuator 54.

FIG. 10B shows a relationship between the position of the operation lever L and the operation load when the vessel speed is equal to or higher than the predetermined value. In FIG. 10B, the operation load when the detent roller 51 is at a position at which the detent roller fits in the neutral notch Nn is larger than in the case shown in FIG. 10A. This is because, as shown in FIG. 9, before and after the position of the operation lever L at which the detent roller 51 fits in the neutral notch Nn, control is performed to increase the detent load to a high value, and the load necessary for the detent roller 51 to come out from the neutral notch Nn increases. At the positions at which the detent roller 51 fits in the forward notch Fn and the reverse notch Rn, the detent load is the same as shown in FIG. 10A. At these positions, the actuator 54 is off, and the detent load is at predetermined low values.

As shown in FIG. 9, hysteresis may be introduced into the control of the detent load in the detent load transition state between a high value and a low value. In detail, when the operation lever L is operated from the forward shift position or the reverse shift position toward the neutral position, control is performed to keep the detent load low. On the other hand, when the operation lever L is operated from the neutral shift position toward the forward shift position or the reverse shift position, control is performed to keep the detent load high. Even in this case, control is preferably performed so that the detent loads at positions at which the detent roller 51 fits in the forward notch Fn and the reverse notch Rn are at low values.

By thus controlling the actuator 54, when switching the shift position from the forward shift position to the reverse shift position, the operation load of the operation lever L greatly increases at the neutral position N (refer to FIG. 10B). Therefore, a shift switching operation during high-speed traveling is prevented from being performed by an operator. Thus, from the point of view of prevention of the shift switching operation during high-speed traveling, the maximum operation load of the operation lever L is preferably set to prevent an operator from easily performing a shift switching operation. The above-described control may be performed only when switching the shift position from the forward shift position to the reverse shift position, or may be performed also when switching the shift position from the reverse shift position to the forward shift position.

The description given above is based on the assumption that the vessel V keeps a high speed equal to or higher than the predetermined vessel speed. However, when the actuator 54 is actuated and the detent load is increased, the vessel speed may decrease. In this case, the control of the detent load changes from the state shown by the solid line in FIG. 9 to the state shown by the dashed line in FIG. 9. Specifically, when the vessel speed is lower than the predetermined value, the actuator 54 is turned off and controlled to reduce the detent load. Therefore, the operation load of the operation lever L is as shown in FIG. 10A.

In the above-described preferred embodiments, the second electronic control unit ECU 2 preferably transmits information on the engine rotation speed (speed information) to the first electronic control unit ECU 1, and the first electronic control unit ECU 1 determines whether the engine rotation speed is high or low. However, it is also possible that the second electronic control unit ECU 2 determines whether the engine rotation speed is high or low, and operation control information of the drive unit 16 of the forward-reverse switching mechanism 3 is transmitted from the first electronic control unit ECU 1 to the second electronic control unit ECU 2. In this case, in the second electronic control unit ECU 2, driving of the drive unit 16 of the forward-reverse switching mechanism 3 is controlled based on the received operation control information.

In the above-described preferred embodiments, the vessel speed of the vessel V is preferably determined based on the rotation speed of the engine E. However, it is also possible that the vessel speed is actually measured with a vessel speed detection device, and by using the measured value, the actuator 54 is controlled. Examples of the vessel speed detection device may include a pitot tube, a GPS (Global Positioning System), and a paddle wheel, etc., equipped on the hull H. The vessel speed may be determined by using any one of these devices, or the vessel speed may be determined by combining several of these. Alternatively, a vessel speed estimated based on the rotation speed of the engine E is corrected by any of the above-described speed detection devices, and a corrected value is set as the vessel speed.

In the above-described preferred embodiments, by changing the operation load of the operation lever L by controlling the actuator 54 based on the vessel speed, a shift switching operation during high-speed traveling is prevented. This arrangement may be combined with a control in which the actual shift switching operation is performed when the rotation speed of the engine E lowers to the predetermined value.

The control described in the above-described preferred embodiments are merely non-limiting examples. In other words, further preferred embodiments of the present invention allow for other various controls as long as the control section 60 controls the actuator 54 based on the vessel speed of the vessel V.

Figure 11:
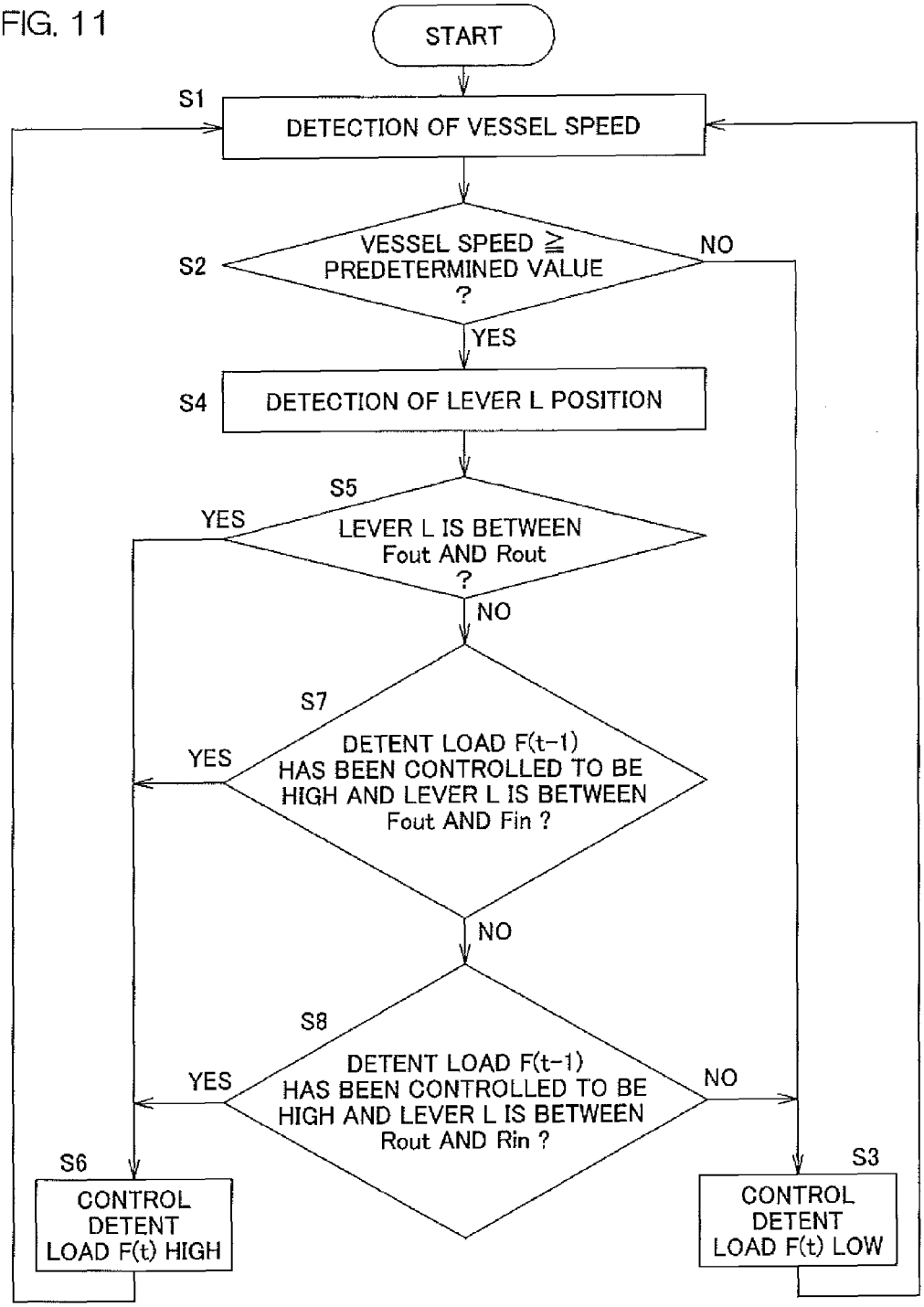
FIG. 11 is a flowchart of a remote control method for a vessel propulsion device according to a preferred embodiment of the present invention.

FIG. 11 shows a flowchart of a remote control method for a vessel propulsion device in a preferred embodiment according to the present invention. In Step S1, the vessel speed is detected. Then, in Step S2, it is determined whether the detected vessel speed is equal to or higher than the predetermined value. When the detected vessel speed is lower than the predetermined value (NO in Step S2), the detent load is controlled to be low in Step S3. For example, the actuator 54 is kept off. Then, the routine returns to Step S1.

On the other hand, when the detected vessel speed is equal to or higher than the predetermined value in Step S2 (YES in Step S2), the program advances to Step S4. In Step S4, the position of the operation lever L is detected. Then, in Step S5, it is determined whether "the operation lever L is in a range between the forward shift-out position Fout and the reverse shift-out position Rout." When it is determined that the operation lever L is in the above-described range (YES in Step S5), the detent load F(t) is controlled to be high in Step S6, and the program returns to Step S1.

On the other hand, when it is determined that the operation lever L is out of the range in Step S5 (NO in Step S5), the program returns to Step S7. In Step S7, it is determined whether "the detent load F(t−1) has been controlled to be high and the operation lever L is in the range between the forward shift-out position Fout and the forward shift-in position Fin." When the above-described conditions are satisfied in Step S7 (YES in Step S7), the detent load F(t) is controlled to be high in Step S6, and the program returns to Step S1.

On the other hand, in Step S7, when the above-described conditions are not satisfied (NO in Step S7), in Step S8, it is determined whether "the detent load F(t−1) has been controlled to be high and the operation lever L is in the range between the reverse shift-out position Rout and the reverse shift-in position Rin." When the above-described conditions are satisfied in Step S8 (YES in Step S8), the detent load F (t) is controlled to be high in Step S6, and the program returns to Step S1. When the above-described conditions are not satisfied in Step S8 (NO in Step S8), the detent load F (t) is controlled to be low in Step S3, and the program returns to Step S1.

The operation load of the operation lever L can be controlled by controlling the actuator 54 as described above. The timing to control the actuator 54 is properly set as necessary. The actuator 54 may be controlled to be on/off simply; however, for example, the actuator may be controlled to adjust continuously or discontinuously (stepwise) the projecting amount of the movable portion 54*c* of the actuator 54.

In the above-described preferred embodiments, the detent roller 51 as a contact member is preferably disposed in contact with the outer peripheral surface 34*a* of the large diameter portion 34 of the rotating member 32 joined to the operation lever L. The notches Fn, Nn, and Rn are provided on the outer peripheral surface 34*a*. However, the detent roller 51 as a contact member may be disposed in contact with the end surface in the rotation axis X direction of the rotating member 32. In this case, the notches Fn, Nn, and Rn are provided on the end surface in the rotation axis X direction of the rotating member 32.

In the above-described preferred embodiments, the detent roller 51 is preferably used as a contact member, and the operation load of the operation lever L is preferably controlled by fitting the detent roller 51 in the notch provided on the rotating member 32, for example. However, further preferred embodiments of the present invention may be arranged so that a non-rotating type contact member preferably is used and the frictional force between the contact member and the rotating member 32 preferably is controlled by the actuator 54, for example.

The terms and expressions used herein are used for description purposes only, and should not be used for limitative interpretation, and are not intended to exclude any equivalents of the characteristic matters shown and described herein. The present invention should be recognized to allow various modifications within the scope of the claims.

The present invention can be embodied in various different modes, embodiments, and examples, and, therefore, this disclosure should be regarded as providing examples of preferred embodiments of the present invention. These preferred embodiments are described here based on the understanding that the preferred embodiments do not limit the present invention to the preferred embodiments described and/or illustrated here.

Various preferred embodiments of the present invention may preferably be used as a remote control device for a vessel to remotely control a vessel propulsion device such as an outboard motor attached to the tail of the hull of a vessel such as a boat from, for example, in a cockpit, etc., of the vessel.

The present application corresponds to Japanese Patent Application No. 2013-080352 filed in the Japan Patent Office on Apr. 8, 2013, and the entire disclosure of the application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A remote control device for a vessel that is installed in a vessel and remotely controls a vessel propulsion device of the vessel, the remote control device comprising:

an operation member that is supported rotatably around a rotation axis, and is operated by an operator to switch a shift position of a forward-reverse switching mechanism in the vessel propulsion device according to an operation angle of the operation member;

an operation load applying mechanism that applies an operation load to the operation member and includes an actuator that adjusts the operation load; and a control section programmed to control the operation load by controlling the actuator based on a vessel speed of the vessel; wherein the vessel propulsion device includes an engine; and the operation member includes a single lever that is operated by the operator to both switch the shift position of the forward-reverse switching mechanism and change a throttle opening degree of the engine according to the operation angle of the operation member.

2. The remote control device for a vessel according to claim 1, wherein the operation member includes an operation lever supported rotatably around the rotation axis in a predetermined angle range, and a rotating member that rotates in response to an operation of the operation lever;

the operation load applying mechanism further includes a contact member that comes into contact with the rotating member; and the actuator changes a pressing load to be applied to the rotating member by operation of the contact member.

3. The remote control device for a vessel according to claim 2, wherein the operation load applying mechanism further includes an elastic member that presses the contact member against the rotating member; and the actuator changes the pressing load to be applied to the contact member by operation of the elastic member.

4. The remote control device for a vessel according to claim 2, wherein the shift position of the forward-reverse switching mechanism includes a forward shift position to make the vessel travel forward, a reverse shift position to make the vessel travel in reverse, and a neutral shift position at which no thrust is applied to the vessel; and when performing a shift switching operation to switch the shift position between the forward shift position and the reverse shift position in a case where the vessel speed of the vessel is equal to or higher than a predetermined value, the control section is programmed to control the actuator so that the pressing load to be applied to the rotating member by the contact member increases when the shift position is switched to the neutral shift position, and the increased pressing load to be applied to the rotating member is kept until the shift position is switched to the forward shift position or the reverse shift position.

5. The remote control device for a vessel according to claim 2, wherein the shift position of the forward-reverse switching mechanism includes a forward shift position to make the vessel travel forward, a reverse shift position to make the vessel travel in reverse, and a neutral shift position at which no thrust is applied to the vessel; and when performing a shift position switching operation to switch the shift position between the forward shift position and the reverse shift position in a case where the vessel speed of the vessel is equal to or higher than a predetermined value, the control section is programmed to control the actuator so that the pressing load to be applied to the rotating member increases when the shift position is switched to the neutral shift position, and the pressing load to be applied to the rotating member by the contact member decreases from a timing at which the shift position is switched to the forward shift position or the reverse shift position.

6. The remote control device for a vessel according to claim 2, wherein the shift positions of the forward-reverse switching mechanism includes a forward shift position to make the vessel travel forward, a reverse shift position to make the vessel travel in reverse, and a neutral shift position at which no thrust is applied to the vessel; and when performing a shift position switching operation to switch the shift position between the forward shift position and the reverse shift position in a case where the vessel speed of the vessel is lower than a predetermined value, the control section is programmed to control the actuator so that the pressing load to be applied to the rotating member by the contact member becomes a predetermined low value regardless of the position of the operation member.

7. The remote control device for a vessel according to claim 3, wherein the rotating member includes a plurality of recesses arranged such that the contact member fits therein to enable the contact member to come out therefrom at positions different in a rotating direction around the rotation axis.

8. The remote control device for a vessel according to claim 3, wherein the contact member is a rolling member arranged to move while rolling on a surface of the rotating member with respect to the rotating member according to rotation of the rotating member around the rotation axis, and the elastic member incudes a spring.

9. The remote control device for a vessel according to claim 1, wherein the vessel speed is determined based on the rotation speed of the engine.

10. The remote control device for a vessel according to claim 1, wherein the vessel speed is determined by a vessel speed detection device including at least one of a pitot tube, a global positioning system, and a paddle wheel.

11. The remote control device for a vessel according to claim 1, wherein the vessel propulsion device and the remote control device are connected to each other with a wire or wirelessly;

the vessel speed is determined in the vessel propulsion device; and a detection signal from the vessel propulsion device is transmitted to the remote control device with a wire or wirelessly.

12. The remote control device for a vessel according to claim 1, wherein the forward-reverse switching mechanism includes a drive gear to be driven by a drive source of the vessel propulsion device, a forward gear and a reverse gear that engage with the drive gear and are driven by the drive gear, and a dog clutch that selectively engages with the forward gear or the reverse gear, and switches the shift position by switching the engagement of the dog clutch between engagement with the forward gear and engagement with the reverse gear; and the shift position includes a forward shift position at which the dog clutch engages with the forward gear, a reverse shift position at which the dog clutch engages with the reverse gear, and a neutral shift position at which the dog clutch engages with neither of the forward gear nor the reverse gear.

13. The remote control device for a vessel according to claim 12, wherein when performing a shift switching operation to switch the shift position between the forward shift position and the reverse shift position in a case where the vessel speed of the vessel is equal to or higher than a predetermined value, the control section is programmed to control the actuator so that the operation load of the operation member necessary for the shift switching operation becomes larger than the operation load of the operation member necessary for an operation other than the shift switching operation.

14. The remote control device for a vessel according to claim 12, wherein in a case where the vessel speed of the vessel is equal to or higher than a predetermined value, the control section is programmed to control the actuator so that the operation load to be applied to the operation member becomes larger, over a predetermined shift switching operation range for switching the shift position between the forward shift position and the reverse shift position, than an operation load to be applied to the operation member for an operation other than the shift switching operation.

15. The remote control device for a vessel according to claim 14, wherein when performing the shift switching operation in a case where the vessel speed of the vessel is equal to or higher than the predetermined value, the control section is programmed to control the actuator so that the operation load of the operation member increases at a timing at which the shift position has been switched to the neutral shift position.

16. A vessel comprising:

a hull;

a vessel propulsion device attached to the hull; and the control device according to claim 1.

17. A remote control method for a vessel propulsion device for remotely controlling a vessel propulsion device installed in a vessel by a remote control device that performs shift position switching, the method comprising:

a step of detecting a vessel speed of the vessel; and a step of controlling an operation load of an operation member in the remote control device with an actuator that controls the operation load based on the detected vessel speed.

18. The remote control method for a vessel propulsion device according to claim 17, wherein in the step of controlling the operation load of the operation member and when performing an operation to switch the shift position in a case where the vessel speed of the vessel is equal to or higher than a predetermined value, the operation load is controlled so that a maximum operation load of the operation member in a predetermined shift position switching operation range including at least a neutral position becomes larger than a maximum operation load of the operation member out of the predetermined shift position switching operation range.

19. The remote control method for a vessel propulsion device according to claim 17, wherein in the step of controlling the operation load of the operation member and when performing an operation to switch the shift position in a case where the vessel speed of the vessel is lower than a predetermined value, a pressing load to be applied to a contact member to be pressed against the operation member becomes a predetermined low value regardless of the position of the operation member.

* * * * *